US010709997B2

(12) United States Patent
Schwartz

(10) Patent No.: US 10,709,997 B2
(45) Date of Patent: Jul. 14, 2020

(54) MAGNETIC DRINKING CUP STACKING TOY

(71) Applicant: Yaacov Schwartz, Brooklyn, NY (US)

(72) Inventor: Yaacov Schwartz, Brooklyn, NY (US)

( * ) Notice: Subject to any disclaimer, the term of this patent is extended or adjusted under 35 U.S.C. 154(b) by 0 days.

(21) Appl. No.: 15/859,677

(22) Filed: Jan. 1, 2018

(65) Prior Publication Data

US 2019/0001234 A1 Jan. 3, 2019

Related U.S. Application Data

(63) Continuation of application No. 15/289,541, filed on Oct. 10, 2016, now abandoned.

(51) Int. Cl.

| | |
|---|---|
| ***A63H 33/04*** | (2006.01) |
| ***A47G 19/22*** | (2006.01) |
| ***A47G 19/23*** | (2006.01) |

(52) U.S. Cl.

CPC ..... *A63H 33/046* (2013.01); *A47G 19/2205* (2013.01); *A47G 19/23* (2013.01)

(58) Field of Classification Search

CPC ..... A63H 33/046; A63H 33/26; A63H 33/04; A47G 19/23; A63F 9/0073

See application file for complete search history.

(56) References Cited

U.S. PATENT DOCUMENTS

| | | | | |
|---|---|---|---|---|
| 655,413 | A | 8/1900 | Parkyn | |
| 3,365,839 | A | 1/1968 | Luchsinger | |
| 3,660,926 | A | 5/1972 | Lerner et al. | |
| 3,670,449 | A * | 6/1972 | Lemkin | A63H 33/088 446/102 |
| 4,660,715 | A | 4/1987 | Anastos | |
| 4,919,268 | A * | 4/1990 | Young | A63H 33/088 206/509 |
| 5,072,936 | A | 12/1991 | Warehime | |
| 5,347,253 | A * | 9/1994 | Ogikubo | A63F 9/12 273/239 |
| 5,447,249 | A * | 9/1995 | Vickers | B65D 81/361 206/511 |
| 6,702,641 | B2 | 3/2004 | Oakley | |
| 7,320,633 | B2 * | 1/2008 | Park | A63H 33/046 446/92 |
| 8,529,311 | B2 | 9/2013 | Tremblay et al. | |
| 9,010,759 | B2 * | 4/2015 | McDonnell | A63F 9/00 273/342 |
| 2004/0029089 | A1 | 2/2004 | Goers et al. | |
| 2007/0037469 | A1 * | 2/2007 | Yoon | A63H 33/046 446/92 |

(Continued)

*Primary Examiner* — Eugene L Kim
*Assistant Examiner* — Alyssa M Hylinski
(74) *Attorney, Agent, or Firm* — Clifford H. Kraft

(57) ABSTRACT

A system with light-weight drinking cups that use small ball magnets embedded in the cup rim and in the bottom cup center. In a preferred embodiment, there can be four magnets at four locations around the rim and a magnet in the center of the bottom of the cup. This arrangement allows cups to be stacked easily even by very young children in a large variety of ways and configurations. The ball magnets align in an attraction mode. Hence, any two cups can be stuck together simply by bringing two of the magnets into proximity. The toy can yield large stacks with connections in many different configurations.

1 Claim, 8 Drawing Sheets

(56) References Cited

U.S. PATENT DOCUMENTS

| | | | | |
|---|---|---|---|---|
| 2007/0110930 | A1* | 5/2007 | Janet | A47G 19/2227 428/34.2 |
| 2008/0128429 | A1* | 6/2008 | Towery | A47G 19/2227 220/574 |
| 2011/0062160 | A1* | 3/2011 | Vasic | A47G 19/2205 220/483 |
| 2011/0220665 | A1 | 9/2011 | McDonnell et al. | |
| 2012/0164913 | A1* | 6/2012 | Pomeroy | A63H 33/046 446/137 |
| 2012/0309259 | A1 | 6/2012 | Mak | |
| 2012/0302127 | A1* | 11/2012 | Doskas | A63H 33/046 446/92 |
| 2013/0048827 | A1 | 2/2013 | Meier et al. | |
| 2015/0065007 | A1* | 3/2015 | Klepper | A63H 33/046 446/92 |
| 2015/0258462 | A1* | 9/2015 | Wei | A63H 33/046 446/92 |
| 2016/0199749 | A1* | 7/2016 | Whittaker | H01F 7/0252 434/278 |

* cited by examiner

MAGNETIC DRINKING CUP STACKING TOY

This is a continuation of application Ser. No. 15/289,541 filed Oct. 10, 2016. Application Ser. No. 15/289,541 is hereby incorporated by reference in its entirety.

BACKGROUND

Field of the Invention

The present invention relates generally to children's toys and more particularly to a magnetic drinking cup stacking toy.

Description of the Prior Art

It is well-known that children and adults like to stack items. There are even stacking contests. In particular, it is known to stack drinking cups or other cups. Drinking cups such as very light weight plastic water cups are very hard to stack because of their light weight, they tend to easy fall, or for the stack to become unstable. Goers in U.S. published patent application 2004/0029089 provided weighted drinking cups that could be more easily stacked. The weights made the cups more stable. However, Goers invention only allowed vertical stacking.

It is also known in the art to attach parts of toys together with magnets or to use magnetic parts. Oakley in U.S. Pat. No. 6,702,641 teaches toy parts with magnetic bases that allow the base of a first part to be attached to the base of a second part and so on to produce connected structures. Lerner in U.S. Pat. No. 3,660,926 teaches building up a toy with magnetically attached parts. Warehime in U.S. Pat. No. 5,072,936 used magnetic marbles to allow stacking of the marbles on a base to see who could stack the most marbles before they fell. None of these magnetic toys addressed the problem of stacking drinking cups.

It is known that small children lack coordination and find it difficult to stack items. It would be advantageous to have a magnetic drinking cup toy that overcame these disadvantages and allowed even very young children to stack light weight plastic drinking cups or other items in numerous stable configurations.

SUMMARY OF THE INVENTION

The present invention provides a system with light-weight drinking cups that use small ball magnets embedded in the cup rim and in the bottom cup center. In a preferred embodiment, there can be four magnets at four locations around the rim and a magnet in the center of the bottom of the cup. This arrangement allows cups to be stacked easily even by very young children in a large variety of ways and configurations. The ball magnets align in an attraction mode. Hence, any two cups can be stuck together simply by bringing two of the magnets into proximity. The toy can yield large stacks with connections in many different configurations.

DESCRIPTION OF THE FIGURES

Attention is now directed to several figures that illustrate features of the present invention.

Several illustrations have been presented to aid in understanding the present invention. The scope of the present invention is not limited to what is shown in the figures.

DESCRIPTION OF THE PREFERRED EMBODIMENTS

The present invention is directed to a magnetic stacking toy where light weight plastic molded cups or light weight drinking cups or other light weight cups can be stacked in numerous different configurations. The cups are equipped with at least four ball magnets on the rim, and at least one ball magnet on the bottom that allow connection to other similar cups. The preferred magnets are ball magnets that align in an attraction configuration. Thus, when the child brings a cup near another cup, magnets in proximity attract and hold the cups in various positions. Because the cups are light weight, they can be arranged at a variety of angles. The ball-magnet pairs hold each other in place on the rim or base of the cup by lightly pinching the cup between them.

Figure 1A:
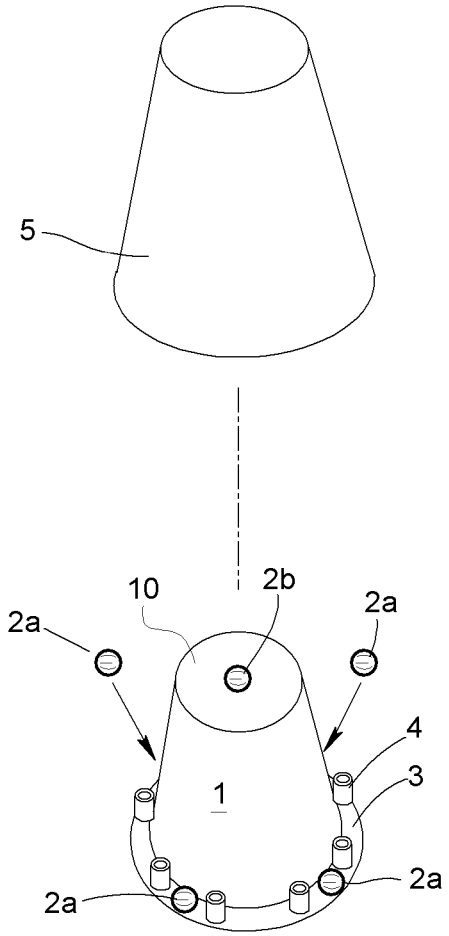
FIGS. 1A-1B show an embodiment of one of the plastic drinking cups both exploded and assembled.
Figure 1B:
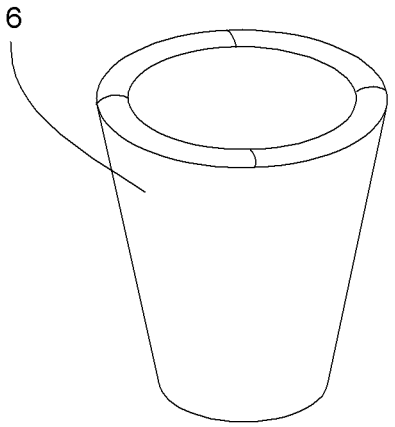

FIGS. 1A-1B show a preferred embodiment of a molded cup. An inner cup form 1 in FIG. 1A is loaded with four ball magnets 2*a* around the rim 3 in small wells each configured to hold such a magnet. A single ball magnet 2*b* is loaded into a recessed area in the cup bottom 10 in a similar well. Screw or rivet receiver structures 4 can be located around the rim 3. An outer cup form 5 is inserted over the inner cup form 1, and the outer form 5 is attached to the inner form 1 embedding the ball magnets 2*a*, 2*b* forming a cup. The region between the inner and outer cup forms can be hollow to make the cup light weight. The outer form can be attached to the inner form with rivets, screws, glue or by any other attachment method.

Figure 2A:
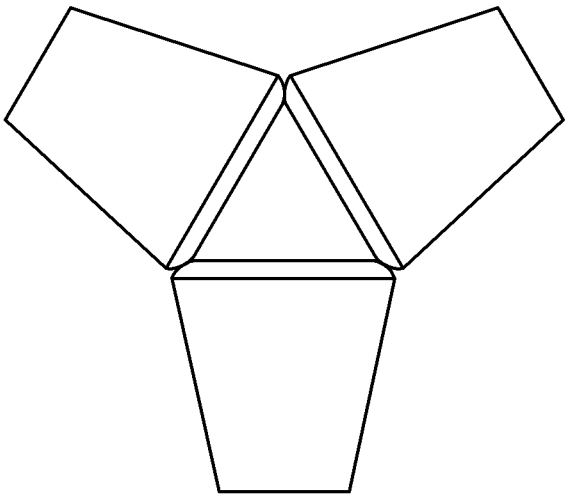
FIGS. 2A-2B show two different ways the cups of FIG. 1B can be stacked.
Figure 2B:
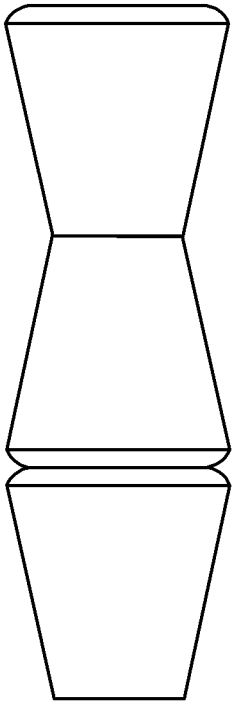

FIGS. 2A-2B shows ways the embodiment of FIG. 1B can be stacked. Many other stacking arrangements are possible.

Figure 3:
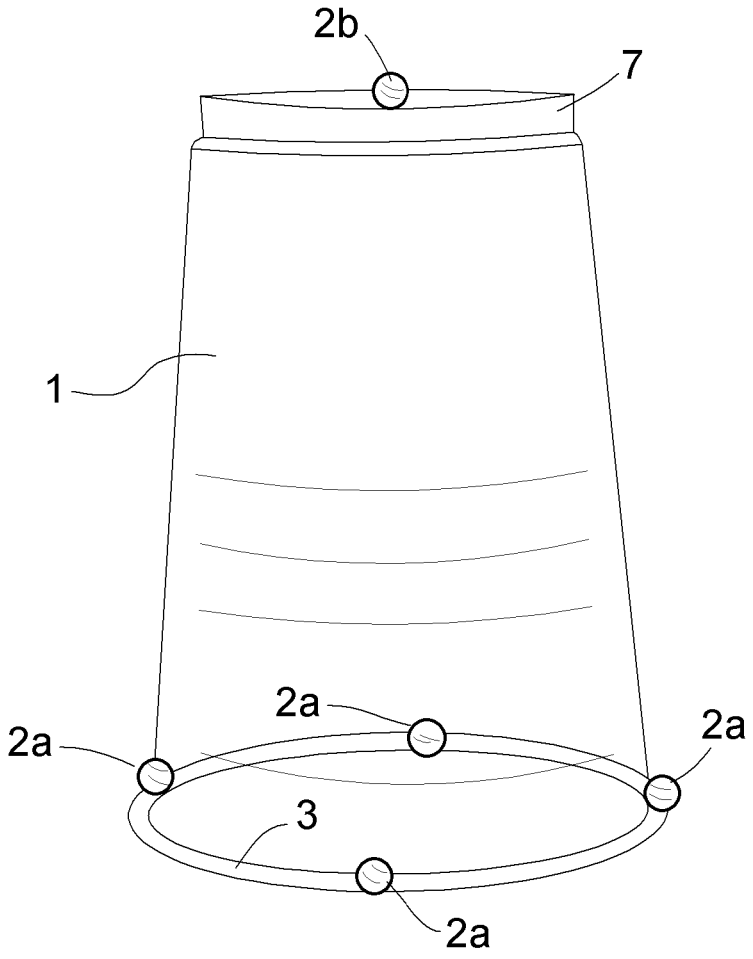
FIG. 3 shows an alternate embodiment of the present invention using a transparent drinking cup.

FIG. 3 shows an alternative embodiment of the present invention. A light weight, transparent plastic drinking cup 1 is equipped with a set of four ball magnets 2*a* in four positions around its rim 3 that are approximately equidistant from one-another. The cup is also equipped with a single ball magnet 2*b* attached to the approximate center of the cup bottom 7. In this embodiment, there is one magnet in each position. In alternate embodiments, there can be as many as two or three magnets in each position, or any other combination of magnets. In the case of a transparent cup, the magnets are attached to the cup with adhesive or by other methods. In alternate embodiments, there can be magnets at two, three, five or any number of positions around the rim.

The preferred cup is a molded light weight plastic cup or a water drinking cup that is transparent; however, any type of light weight cup is within the scope of the present invention including paper cups such as coffee cups. Also, while ball magnets are preferred because of their tendency to align in an attraction mode, any type of small magnet is within the scope of the present invention. As stated, each magnet can be embedded in the molded plastic as in FIGS.

1A-1B, or can be attached to the cup in any manner. Any attachment method is within the scope of the present invention.

Figure 4:
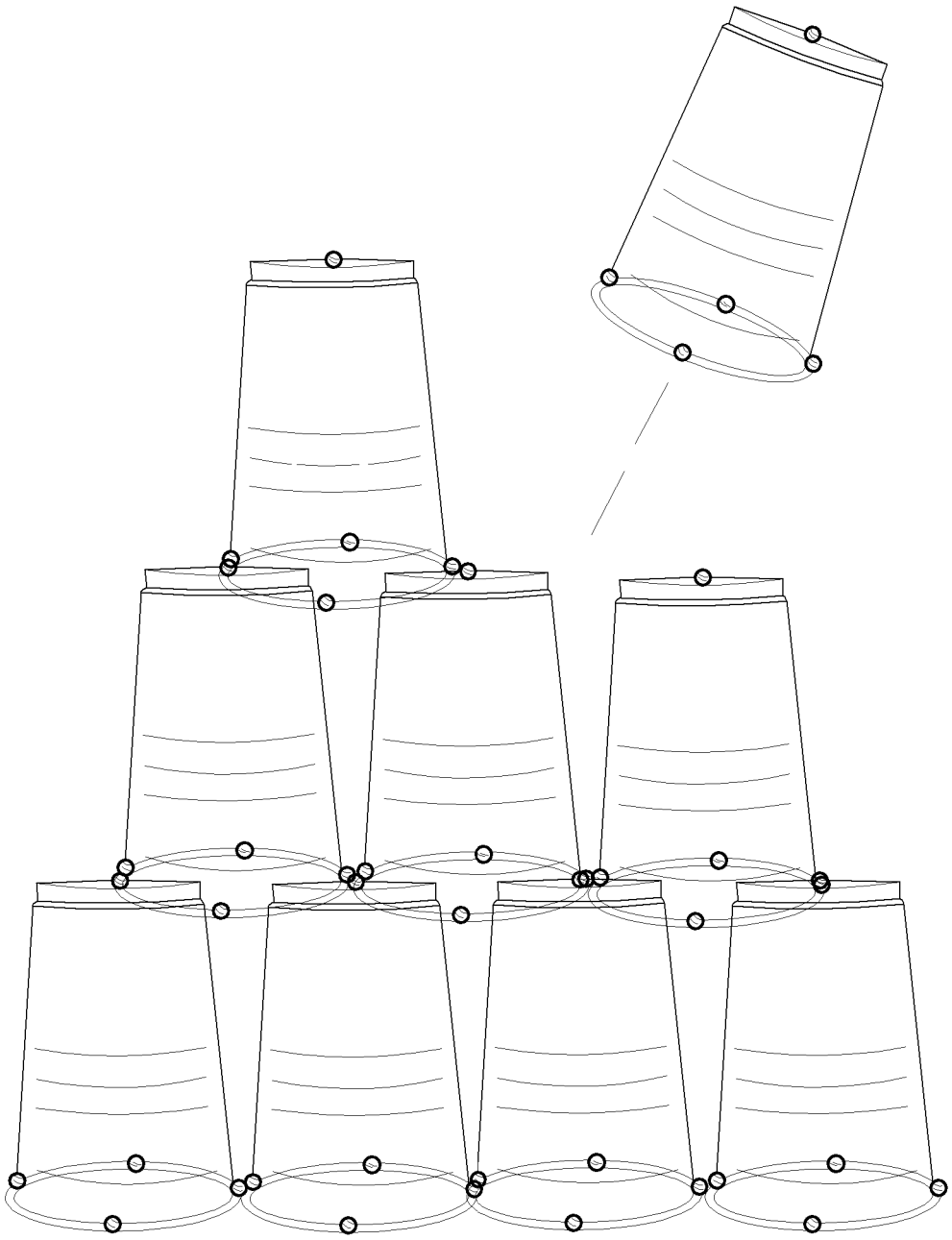
FIG. 4 shows a straight linear pyramid stack in progress with the embodiment of FIG. 3.

FIG. 4 shows a linear stack of similar transparent toy cups in progress, in this case to form a flat pyramid. It is also very easy to form a 3-dimensional pyramid simply by extending the stack in other horizontal directions. It is possible to stack the toy cups of the present invention in any geometric pattern.

Figure 5:
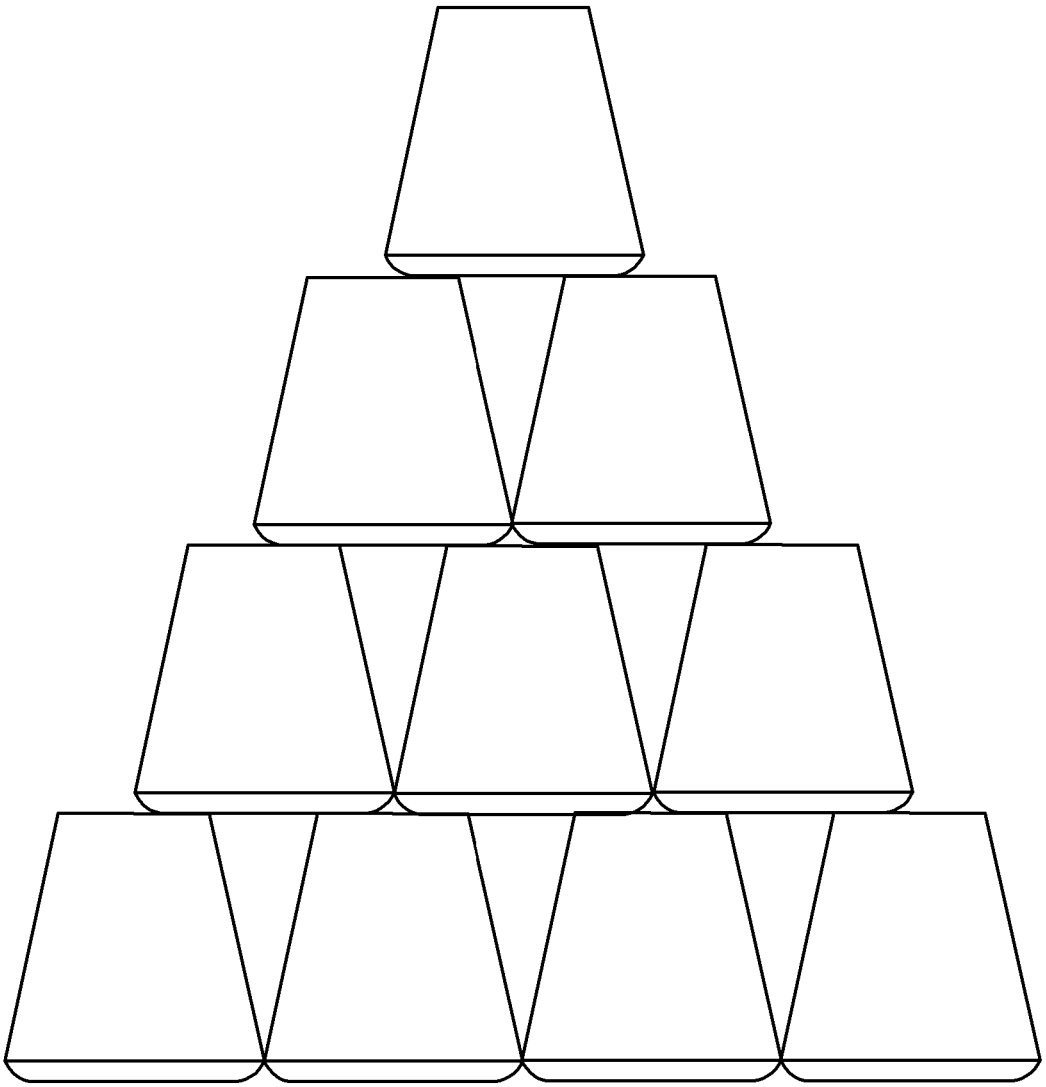
FIG. 5 shows a linear stack with the embodiment of FIG. 1B.

FIG. 5 shows a similar stack of cups of the type with embedded magnets of FIG. 1B.

Figure 6:
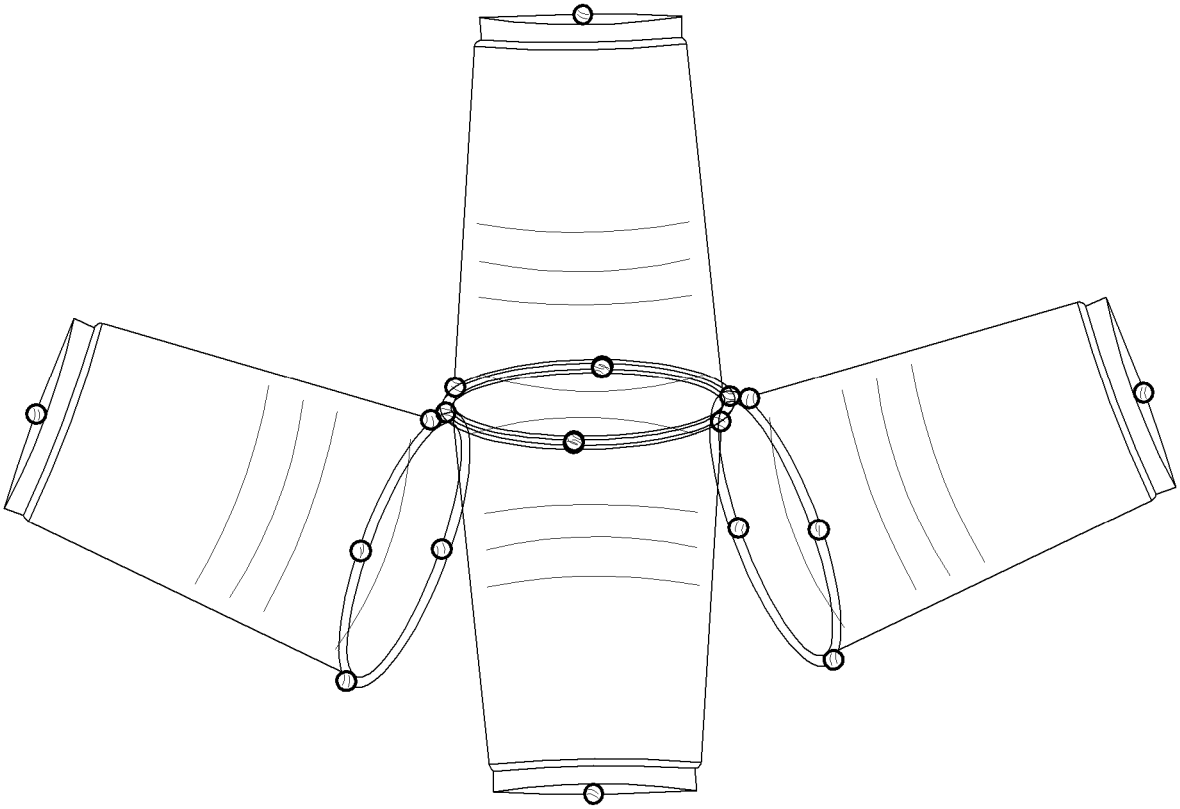
FIGS. 6, 7 and 8 show alternative stacks using the embodiment of FIG. 3.
Figure 7:
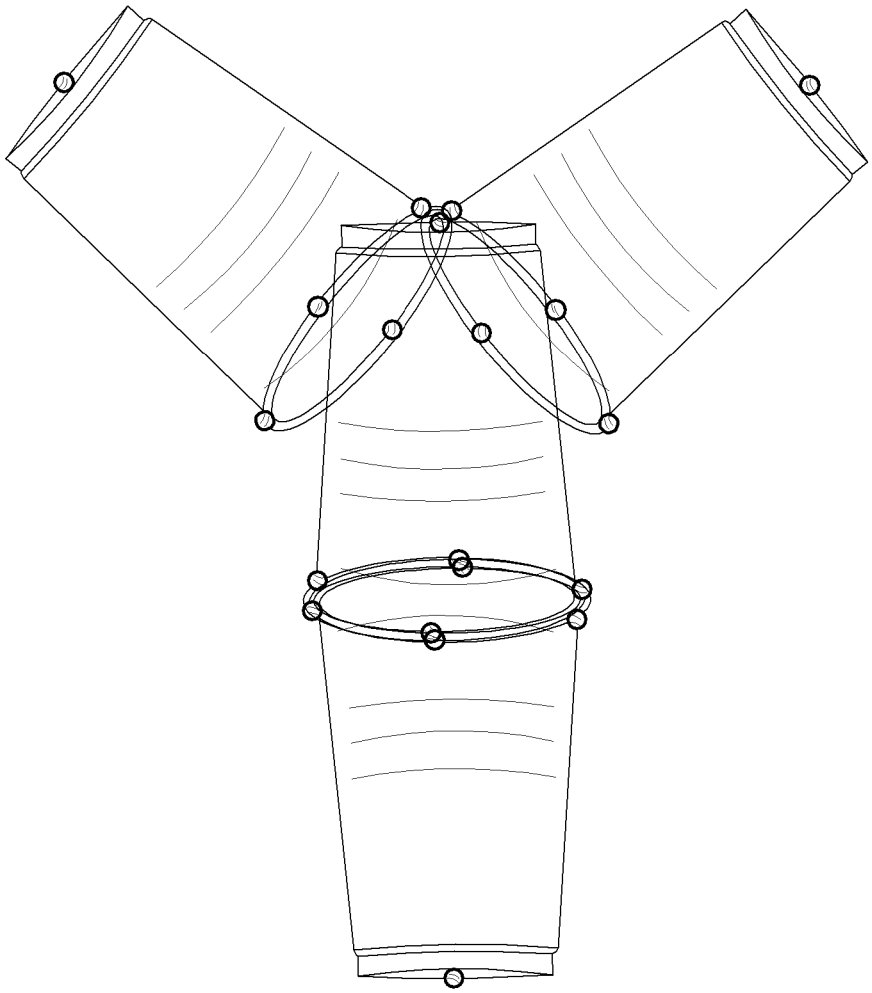

FIGS. 6-7 show how, because of the lightness of the cups, cups can be attached to other cups to "hang" in the air. These are hanging modes and are different from stacking. The hanging modes can be combined in numerous ways with stacking.

Figure 8:
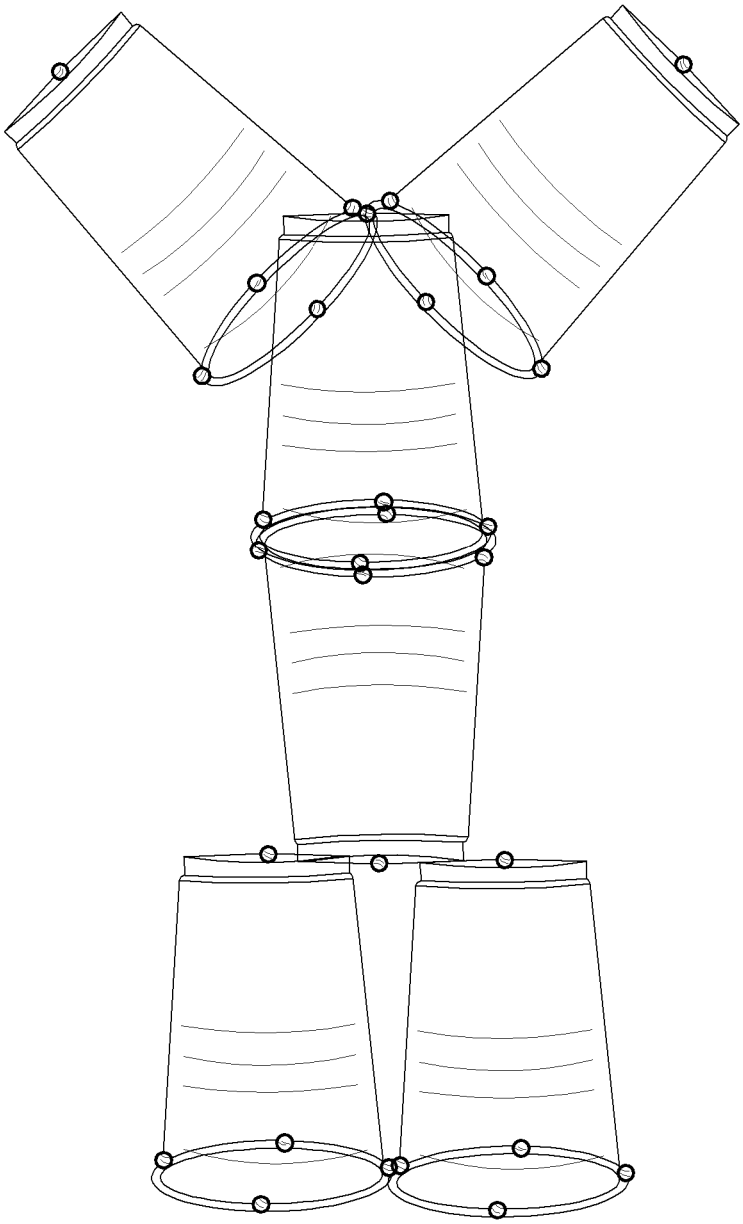

FIG. 8 shows that it is also possible to create stacks where not all connections are made with magnets. In this configuration, the bottom two cups are not magnetically coupled to the lower middle cup. The configuration is held together by friction and gravity. While, this connection method is not as stable as the magnetic connections, it leads to many new and different arrangements.

The present invention includes a system of similar or different light weight cups with ball or other magnets attached or attachable, or simply the magnets with instructions on how to place them on the cups. In some embodiments, the magnets are easily removable and re-attachable such as when they are attached to the cup by pinching the cup material between two of the balls. In other embodiments, the magnets are permanently attached to the cups. In particular, the toy can be made up from a store-bought stack of light weight plastic cups and a package of ball magnets. The user (adult or child) can begin to place the magnets in place two by two on different cups until a number of cups are ready. At that point, the stacking or construction process can begin allowing the child (or adult) to build up an amazing number of different stable stacks or other structures.

The present invention includes any number of magnets located in any configuration on any light weight cup arranged so the cups can be stacked and/or attached to each other. It is also possible in some embodiments to pinch cup material, especially of thin plastic cups between two ball magnets thus adhering the two magnets to the cup.

Several descriptions and illustrations have been presented to aid in understanding the present invention. One with skill in the art will realize that numerous changes and variations may be made without departing from the spirit of the invention. Each of these changes and variations is within the scope of the present invention.

The invention claimed is:

1. A toy cup set comprising:

a set of six substantially cylindrical cups, each cup having a closed flat bottom and a top rim defining a circumference, the top rim being of greater diameter than the closed bottom;

each cup having a centrally located ball magnet embedded in said closed flat bottom;

each cup having four ball magnets embedded in said top rim, the four ball magnets equidistantly spaced around the top rim;

the cups and ball magnets constructed to allow pairs of cups to be magnetically attached to one-another without inserting one cup in another cup, flat bottom-to-flat bottom, attached to one-another rim-to-rim circumferences aligned, attached to one-another side-by-side with rims touching, attached to one-another rim-to-flat bottom, and attached one-to-another with a rim ball magnet of any particular cup in contact with a centrally located ball magnet of any other particular cup, with an angle of approximately 45 degrees between them;

wherein, the set of six cups is constructed to be attached to one another in a particular manner as a child's toy requiring patience and coordination, the set of six cups being constructed so that a first, second, third and fourth cup of the set of six cups can be magnetically attached to one-another rim-to-rim with rims of the first, second, third and fourth cup resting on a flat surface with their flat bottoms upward, the first cup attached to the second cup and the fourth cup, the second cup attached to the first cup and the third cup, the third cup attached to the second cup and the fourth cup, and the fourth cup attached to the third cup and the first cup, the first, second, third and fourth cups being substantially parallel; and wherein, the set of six cups is constructed so that a fifth cup of the set of six cups can be magnetically attached to the first, second, third and fourth cups, rim down, so that the four ball magnets in the rim of the fifth cup is each magnetically attached to the ball magnet embedded in the flat bottom of the first, second, third and fourth cups respectively, and the fifth cup is located above the first, second, third and fourth cups; and is substantially parallel to the first, second, third and fourth cups, and, wherein, the set of six cups is constructed so that the sixth cup of the set of six cups can be magnetically attached bottom-to-bottom to the fifth cup so that the sixth cup is above the fifth cup with its rim upward, linearly aligned with the fifth cup and substantially parallel to the first, second, third, fourth and fifth cups;

whereby, the set of six cups forms a child's toy constructed to challenge the child to stack them in the particular manner.

* * * * *